United States Patent [19]

Rojas

[11] Patent Number: 4,802,463

[45] Date of Patent: Feb. 7, 1989

[54] FOOT MASSAGER

[76] Inventor: Teresa M. Rojas, 9715 NW. 6th La., Miami, Fla. 33172

[21] Appl. No.: 112,952

[22] Filed: Oct. 26, 1987

[51] Int. Cl.[4] ..... A61H 1/00

[52] U.S. Cl. ..... 128/36; 128/582

[58] Field of Search ..... 128/24 R, 25 B, 35, 128/36, 32–34, 582, 592, 593, 583

[56] References Cited

U.S. PATENT DOCUMENTS

| | | | |
|---|---|---|---|
| 2,734,286 | 2/1956 | Anson | 128/582 |
| 3,457,911 | 7/1969 | Carpenter | 128/36 |
| 3,463,163 | 8/1969 | Matles | 128/583 |
| 3,464,405 | 9/1969 | Kallus | 128/36 |
| 3,595,244 | 7/1971 | Kugler | 128/582 |
| 3,731,674 | 5/1973 | Parvin | 128/582 |
| 3,732,860 | 5/1973 | Thurmer | 128/36 |
| 3,811,430 | 5/1974 | Kawakamii | 128/36 |
| 3,942,520 | 3/1976 | McNair | 128/24.1 |

*Primary Examiner*—Paul T. Sewell
*Assistant Examiner*—Huong Q. Pham
*Attorney, Agent, or Firm*—J. Sanchelima

[57] ABSTRACT

A foot massaging device that is housed within a compartment provided above the sole in a footwear article that includes an upper or a strap that maintains the massaging device abutting with the sole of the user's foot. A vibrating motor is on a platform member that extends substantially throughout the length of the sole and several plastic tubular pieces that are rigidly mounted on the upperside of the platform are used to transmit the vibration of the motor to the sole of the user's foot. A battery pack with a switch is provided to feed the motor and it is preferably mounted on the side of the footwear article.

4 Claims, 1 Drawing Sheet

FOOT MASSAGER

BACKGROUND OF THE INVENTION

1. Field of the Invention

The present invention relates to foot massage devices, and more particularly, to such devices that conform to the foot of the user.

(2.) Description of the Related Art

A number of devices have been designed in the past that provide soothing massages to a user's feet. Most of these devices are fixed to a location thereby practically immobilizing the user. Furthermore, the devices known to applicant are, at best, difficult to use if a user wants to raise his or her feet while receiving the massage.

Applicant believes that the closest reference corresponds to U.S. Pat. No. 3,942,520 issued to McNair in 1976. However, it differs from the present invention because it provides a massager that requires a user to sit in front of the device limiting his or her movements.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a foot massager that is ambulatory and minimizes its interference with a user's movements.

It is another object of this present invention to provide such a foot massager that can be used in any position.

It is yet another object of the present invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
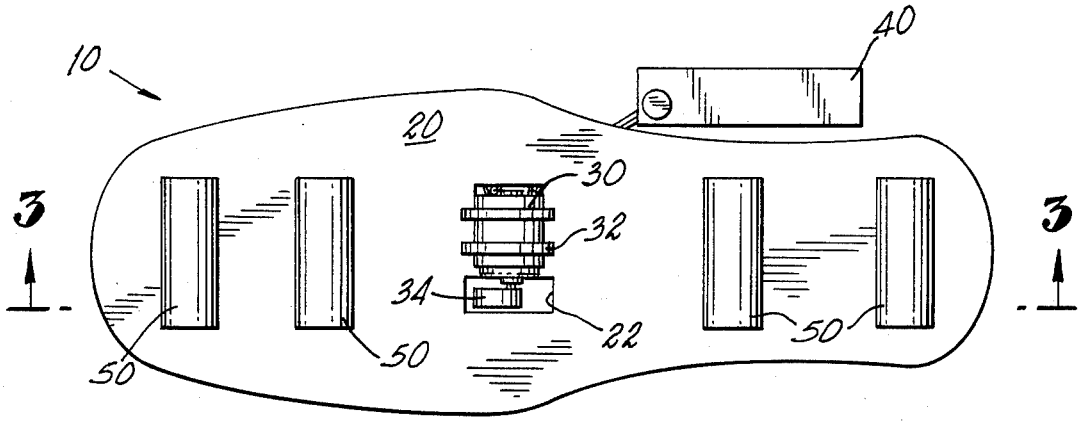
FIG. 1 represents a top view of the foot massager with the upper and top cushion members removed.
Figure 2:
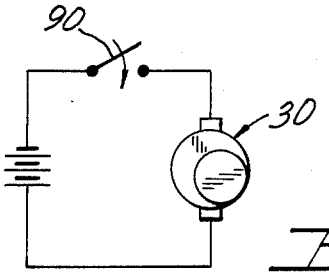
FIG. 2 shows an electric diagram of the circuit for activating the motor vibrator.
Figure 3:
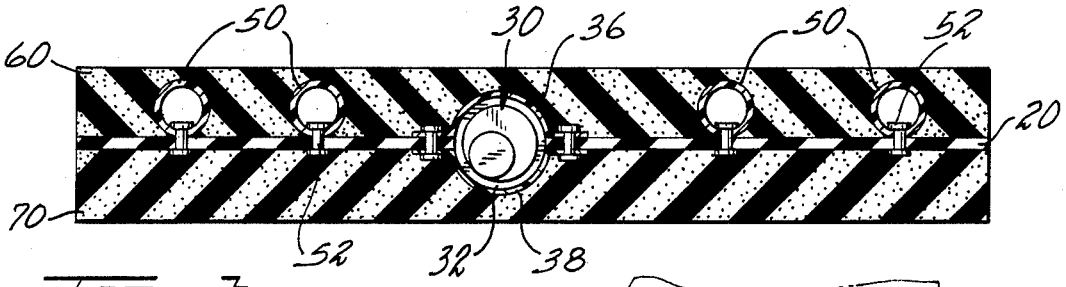
FIG. 3 illustrates a cross-sectional view taken along line 3—3 in FIG. 1.
Figure 4:
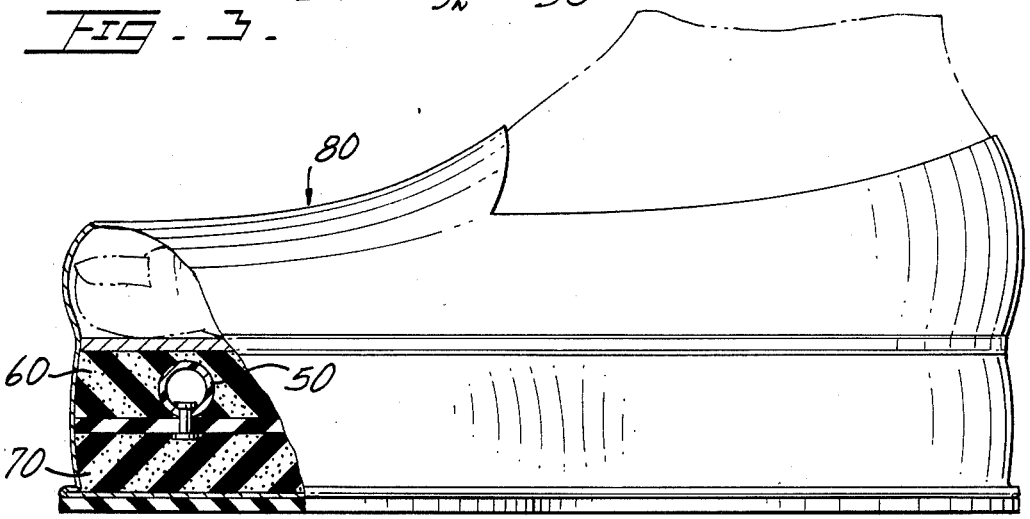
FIG. 4 is a representation of a side elevational view of the foot massager showing a partial cross-section.

Referring now to FIG. 1, where the present invention is generally referred to with numeral 10, it can be observed that it basically includes a resilient platform member 20 having substantially the shape of the foot projection, a motor vibrator assembly 30, a battery assembly 40 connected to motor vibrator assembly 30, and several vibration transmitters 50 rigidly mounted to the upperside of member 20. Platform member 20 is preferably made out of a plastic material. This combination of elements being sandwiched by top and bottom cushion members 60 and 70, as best shown in FIG. 3. Cushion members 60 and 70 substantially follow the contour of platform member 20.

An upper 80 of any suitable design is used to keep platform member 20 against the sole of the user's foot thereby insuring the transmission of the massage.

Motor vibrator assembly 30 is preferably of the eccentric type so that it produces a vibration that is transmitted through rubber rings 32 fastened to platform member 20. Rubber rings 32 are intended to dampen somewhat the vibrations of assembly foot 30 to avoid tickling the user's foot. A cooperating cutout 22 in platform member 20 provides space for motor vibrator assembly 30, including eccentric wheel 34 having an offcentered weight. Securing straps 36 and 38 secure the body of motor vibrator assembly 30 to platform member 20 from its upperside and underside, respectively.

Several vibration transmitting member 50 are selectively and rigidly mounted on the upperside of platform member 20. In the preferred embodiment rivet member 52 are used to secure members 50 to platform member 20 but it is also possible to use other fastening means such as nuts and bolts. Vibration transmitting members 50 are preferably made out of sections of semi-rigid plastic material such as the ones used in hoses and flexible conduits. The important desired characteristics are that they be rigidly mounted to platform member 20 and that when a user's sole applies pressure to top cushion member 60 he or she does not feel a hard object. This objective also requires the positioning of motor vibrator assembly 30 in an area of member 20 that substantially coincides with the arc of the user's foot.

While the present invention is not designed for extended walks, it nevertheless permits a user to be ambulatory for certain minor activities such as standing up to turn on or off an appliance, etc. A user may, if desired, raise his or her feet or position them in the most comfortable position.

Switch member 90 allows a user to selectively interrupt the vibration of motor 30. Battery assembly 40 is preferably implemented with a battery pack of commercially available electric batteries of small dimensions and weight.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense.

What is claimed is:

1. A foot massaging device, comprising:

A. a platform member having substantially the shape of the sole of a foot and being made of a substantially resilient material, and said platform member further including an upperside and an underside;

B. motor means for producing vibrations rigidly mounted to said platform member;

C. first cushion means for cushioning positioned on said upperside and having substantially the same projected dimensions as said platform member;

D. second cushion means for cushioning positioned on said underside and having substantially the same projected dimensions as said platform member;

E. battery means for providing electricity and connected to said motor means;

F. an upper member covering said first and second cushion means for cushioning and urging them towards the sole of the user's foot; and G. a plurality of vibration transmitting means rigidly mounted to the upperside of said platform and covered by said first means for cushioning;

said vibration transmitting means comprises a tubular section made out of a substantially flexible material so that the user's sole does not come in contact with an uncomfortably hard object if the user applies his weight on said transmitting means.

2. The device set forth in claim 1 further including:

H. switch means for selectively interrupting the connection between said battery means and said motor means.

3. The device set forth in claim 2 wherein rubber rings are fastened to said platform member, said platform member includes a cutout for housing said motor means so that it is kept protruding substantially the same distance through said upperside as through said underside and said motor means being structurally mounted to said platform member through said rubber rings.

4. The device set forth in claim 3 wherein said cutout for said motor means coincides with the area where the user's arc is.

* * * * *